US005749979A

United States Patent [19]

Carrano et al.

[11] Patent Number: 5,749,979

[45] Date of Patent: May 12, 1998

[54] 14K GOLD ALLOY WITH SILVER, COPPER, ZINC AND COBALT

[75] Inventors: Richard Carrano, Attleboro, Mass.; Mark C. Hanna, Barrington, R.I.

[73] Assignee: Dalow Industries Inc., Long Island City, N.Y.

[21] Appl. No.: 707,067

[22] Filed: Sep. 3, 1996

[51] Int. Cl.[6] ..... C22C 5/02

[52] U.S. Cl. ..... 148/430; 420/511

[58] Field of Search ..... 420/511, 512, 420/508, 509, 510; 148/430, 405; C22C 5/02

[56] References Cited

U.S. PATENT DOCUMENTS

| | | | |
|---|---|---|---|
| 2,169,592 | 8/1939 | Peterson . | |
| 2,248,100 | 7/1941 | Loebich | 420/511 |
| 3,981,723 | 9/1976 | Tuccillo . | |
| 5,173,132 | 12/1992 | Solomon | 148/405 |
| 5,180,551 | 1/1993 | Agarwal | 420/511 |

FOREIGN PATENT DOCUMENTS 63-259042 10/1988 Japan .

OTHER PUBLICATIONS

"Grain Refining in 14K Gold Alloys" by L. Gal-Or and M. Riabkina-Fishman, The Sante Fe Symposium on Jewelry Manufacturing Technology (1987), Ed. by D. Schneller, Met-Chem Research Inc., Boulder Colorado (1988), pp. 125-141.

*Primary Examiner*—George Wyszomierski
*Assistant Examiner*—Margery S. Phipps
*Attorney, Agent, or Firm*—Helfgott & Karas, PC.

[57] ABSTRACT

A 14K gold alloy includes by weight percentages about 58.5 to 58.8% gold, 12.8 to 14.4% silver, 22.9 to 24.8% copper, 3.5 to 4.1% zinc and 0.2 to 0.5% cobalt. The alloy exhibits a relatively large uniform, fine grain size and may be repetitively hardened and softened as desired. The brightness of the alloy is exceptional and the color, which is quite distinctive among 14K gold alloys, is similar to rich colored 18K gold alloys.

17 Claims, 3 Drawing Sheets

14K GOLD ALLOY WITH SILVER, COPPER, ZINC AND COBALT

BACKGROUND OF THE INVENTION

1. Field of the Invention

The present invention relates in general to a gold alloy adapted for the production of jewelry and relates particularly to a brilliant 14K gold alloy which exhibits a rich bright color similar to 18K gold. The alloy can be easily softened for mechanical working and later age hardened to a highly durable condition.

2. Description of Prior Developments

Gold has long been used to produce fine jewelry and other decorative items due to its superior malleability, ductility and beautiful color. Unfortunately, these traits generally result in jewelry which can be easily scratched, dented and bent. To strengthen the metal, metallurgists have combined gold with elements which reduce its grain size and create greater cohesiveness between grains. Although this results in a harder and more durable alloy, the alloy may become too brittle to be mechanically worked.

In order to facilitate the working and forming of gold alloys, many different combinations of alloying elements and heat treatments have been attempted. Although some gold alloys have been developed which can be worked in a softened or annealed condition and subsequently hardened, the resulting color of these alloys has often been found to be less than satisfactory. Moreover, even after annealing, some of these alloys are relatively difficult to mechanically work.

A desirable characteristic of a gold alloy is its ability to be reverse hardened. That is, an article of jewelry is typically heat treated such as by solution annealing and subsequent age hardening. If the jewelry article is subsequently formed and thereby softened, to be mechanically worked, it is desirable to be able to return its hardness to a superior hardened condition.

Accordingly, a need exists for a hardenable gold alloy which is readily workable, durable, and scratch resistant and which maintains a desirable gold color even after multiple heat treatments. A further need exists for such a gold alloy which can be hardened, then cast or softened by heat, formed into a desired shape by working, and then rehardened by age hardening.

SUMMARY OF THE INVENTION

The present invention has been developed to fulfill the needs noted above and therefore has as an object the provision of a gold alloy which may be initially heat treated by solution annealing to a Vickers Hardness Number (VHN) lower than almost all other 14K gold alloys and subsequently hardened by age hardening to a VHN greater than almost all other hardenable 14K gold alloys.

Another object of the invention is to provide a 14K gold alloy which is exceptionally bright and lustrous and which exhibits a rich gold color associated with more expensive 18K gold alloys.

Another object of the invention is to provide a 14K gold alloy which has a lower red color value than certain prior known 14K gold hardenable alloys and a higher yellow color value than most other 14K alloys which gives gold its characteristic rich gold color.

Still another object of the invention is to provide a hardenable gold alloy which is more easily mechanically worked than other hardenable gold alloys yet, after final hardening, is scratch resistant, dent resistant and sufficiently resilient to form durable springs and clasps for jewelry and other articles.

Another object of the invention is to provide a gold alloy which can have its hardness reversed to a softened state then rehardened after the alloy has been processed. For example, the alloy should be able to be drawn, stamped, cast or embossed while softened or annealed and then rehardened after the alloy has been so processed.

Yet another object of the invention is to provide a hardenable gold alloy which eliminates the use of nickel as an alloying element in order to prevent any adverse allergic reactions or other undesirable affects due to contact of the alloy with the skin known as nickel sensitization.

Another object of the invention is to provide a 14K gold alloy which possesses elevated amounts of gold, silver and zinc and a reduced amount of copper.

Still another object of the invention is to provide a hardenable gold alloy which is particularly adapted to forming jewelry such as, but not limited to, earrings of all types, hollow link rope, herringbone chain, bangles and rings.

Another object of the invention is to provide a 14K gold which has a density greater than conventional 14K gold alloys.

Still another object is to provide a 14K gold alloy having a hardenability ratio greater than virtually all other commercially available 14K gold alloys in order to maximize the durability of the alloy.

These and other objects are fulfilled by the present invention which is directed to a gold alloy which includes about 58.5 to 58.8% by weight of gold, 12.8 to 14.4% by weight of silver, 22.9 to 24.8% by weight of copper, 3.5 to 4.1% by weight of zinc, and 0.2 to 0.5% by weight of cobalt.

This particular combination of alloying elements results in a nickel additive-free 14K gold alloy with maximum hardenability potential and having a rich gold color more similar to that of 18K gold alloys than conventional 14K gold alloys.

The alloy produced in accordance with the present invention is exceptionally bright when measured on a CIE LAB "L" scale, is less red than other hardenable gold alloys when measured on a CIE LAB "a" scale, and is at a virtually optimum value when measured on a CIE LAB "b" scale. In fact, the alloy of the present invention has tested as the brightest of any commercially comparable hardenable 14K gold alloy and appears very similar in color and brightness to a conventional and highly desirable 18K gold alloy known in the trade as 18–88.

The hardenability of the gold alloy produced in accordance with the invention is exceptional. As measured by the relative heat treatability or hardenability ratio of a 14K alloy, one nominal formulation of the present invention resulted in a hardenability ratio of 35.85% and another formulation of the present invention resulted in a hardenability ratio of 36.02%. This ratio percent is calculated by dividing the weight percent of silver by the sum of the weight percents of silver plus copper and multiplying the result by 100, as discussed in U.S. Pat. No. 5,173,132 which is incorporated herein by reference.

After the alloy of the present invention has been melted and formed into an article such as an article of jewelry, it may be solution annealed at about 1150° F. to 1250° F. for about 30 to 60 minutes. It must then be immediately water quenched. It may then be mechanically worked.

After annealing, the article may be mechanically worked then age hardened by heat treatment at about 600° F. to 700° F. for 20 to 75 minutes. Maximum hardness usually is achieved at about one hour. Age hardening may also be performed on articles which have been cold worked, provided the articles are first annealed as noted above prior to cold working.

After annealing, the alloy of the present invention has one of the lowest (softest) VHN values of any 14K gold alloy and, after age hardening, the same alloy has one of the highest (hardest) VHN values of any 14K gold alloy. This means that the alloy can be very easily worked, shaped and formed in its softened or annealed condition then hardened to an extremely hard and durable condition, thereby providing a long life to articles formed with the alloy. Moreover, the difference between the VHN of the present invention in its annealed condition and in its age hardened condition is over an absolute VHN range greater than 100 VHN and is the greatest of any known and tested 14K gold alloy.

The alloy according to the present invention can be used for the production of a wide assortment of jewelry items and is particularly adapted for forming high strength and spring type products. It is also excellent for fabricating lightweight and thin products which require extra durability. The alloy may be provided in various forms including, but not limited to, sheet, wire, tubing, casting grain, rolling grain and billet or ingot.

The alloy has a melting point of about 1575° F. and may be investment cast at about 1700° F. Sheet and wire ingots can be cast at about 1850°. Brazing with solders having a flow point below 1400° F. produces best results with either torch or furnace brazing techniques.

As noted above, the brightness and color of gold alloys produced according to the present invention are exceptional. These attributes have been measured using a color reference system of the International Committee on Illumination (CIE) wherein three variables are used to describe the color of an object.

The first variable "L" is brightness which varies from 0 for absolute black to 100 for absolute white or reflective surfaces. The next is a red-green value "a" which varies from negative 100 for absolute green to positive 100 for absolute red. The third variable is a yellow-blue value "b" which varies from negative 100 for absolute blue to positive 100 for absolute yellow.

The CIE LAB system has been adapted by the Manufacturing Jewelers and Silversmiths of America (Providence, R.I.) and endorsed by the World Gold Council in the form of a Gold Color Reference Kit which has been used to provide the color data listed below as in Table 2, for example.

Because of the distinct brightness and rich color achieved by the present invention, gold articles formed from the gold alloy can be easily visually distinguished from other conventional gold alloys so as to provide a marketing advantage over other gold alloys which are often indistinguishable from one another.

The aforementioned objects, features and advantages of the invention will, in part, be pointed out with particularity, and will, in part, become obvious from the following more detailed description of the invention.

BRIEF DESCRIPTION OF THE DRAWINGS

In the Drawings.

In the various figures of the drawings, like reference characters designate like parts.

DETAILED DESCRIPTION OF THE PREFERRED EMBODIMENTS

Figure 1:
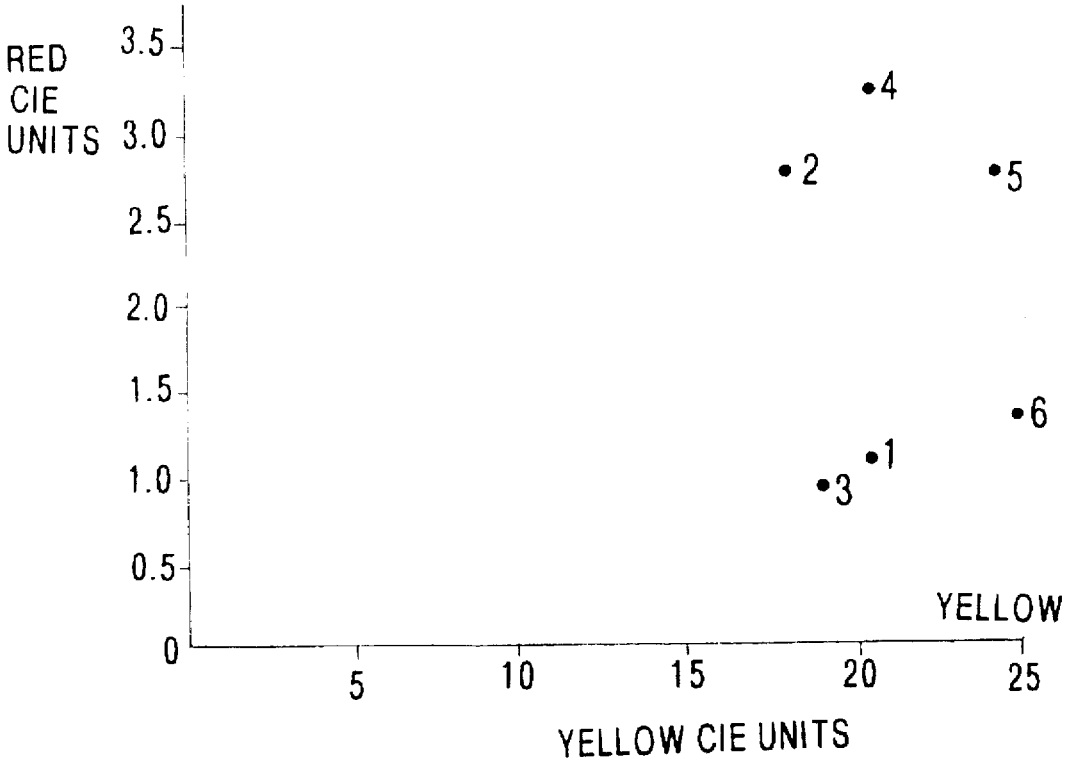
FIG. 1 is a color graph derived from the CIE LAB System for color measurement plotting the red and yellow coordinates of a gold alloy formulated in accordance with the present invention as well as various other commercial gold alloys.

In order to achieve improved workability and durability in combination with a distinct rich gold color, a hardenable gold alloy has been formulated with relatively high concentrations of gold, silver and zinc and a relatively low concentration of copper as compared to other known 14K gold alloys. The high concentrations of gold, silver and zinc promote mechanical workability and result, prior to final heat treatment, in a relatively soft alloy.

The ranges of the constituent elements of the present invention as well as the nominal composition values are set forth below in Table 1.

TABLE 1

ALLOY COMPOSITION

| Element | Minimum | Maximum | Nominal |
|---|---|---|---|
| Au (Gold) | 58.530 | 58.800 | 58.700 |
| Ag (Silver) | 12.800 | 14.390 | 13.390 |
| Cu (Copper) | 22.960 | 24.800 | 23.960 |
| Zn (Zinc) | 3.500 | 4.080 | 3.580 |
| Co (Cobalt) | .200 | .500 | .370 |

The hardness ratio of a gold alloy is computed as the ratio of copper to silver and provides an indication of the hardness of the alloy. It can be readily seen from Table 1 that the range of the copper/silver ratio for the present invention varies from 24.8/12.8 or 1.9375 to 22.96/14.39 or 1.5955. This ratio range is relatively low compared to similar conventional and commercially available 14K prior known gold alloys and results in a superior hardenability potential. Moreover, the range of the ratio of copper to the sum of silver plus twice the amount of zinc, referred to as the color ratio "C" of other known hardenable 14K gold alloys, is also lower than that of other conventional 14K gold alloys.

This lower color ratio of 24.8/[12.8+2(3.5)] to 22.96/[14.39+2(4.08)] or 1.252 to 1.018 produces a distinctive gold color which is easily distinguished from other 14K gold alloys. Also, by maintaining the gold alloy within this range, the hardness of the alloy may be "reversed" or softened, then hardened again via heat treatment. Moreover, the resulting color of the alloy is less red than other gold alloys thereby producing a more desirable color similar to a rich 18K gold color exhibited by a commercial 18K alloy known as 18–88.

The maximum achievable hardness of a gold alloy can be estimated by a ratio known as the hardenability ratio. This ratio can be considered as the measure of the potential to reach the maximum hardness. The hardenability ratio of the nominal composition of the present invention, measured as the ratio of the weight percent of silver, divided by the sum of the weight percents of silver plus copper, and multiplied by 100, yields 35.85%. That is, [3.39/(13.39+23.96)]100= 35.85 which is a maximum commercially available ratio for hardenability.

The hardenability ratio reflects or indicates the relative heat treatability for optimization and hardness potential by optimizing the silver to silver plus copper ratio in order to improve the heat treatability of a gold alloy. The yellow gold alloy of the present invention has a heat treatability or hardenability ratio of 36.02 for the specific formulation tested in Table 11. This is significantly superior to that of other 14K alloys identified in Table 11.

Another significant advantage of the present invention is its brightness which is brighter than tested comparable 14K gold alloys. The present invention is identified as test sample 1 on Table 2 wherein various color values are tabulated. As shown on Table 2, the CIE LAB color coordinates a, b, L and the color ratio C are provided for the nominal composition of the present invention, i.e. 58.70% gold, 13.39% silver, 23.96% copper, 3.58% zinc and 0.37% cobalt (all by weight percentages) and for other commercially available gold alloys.

TABLE 2

COMPARATIVE COLOR ANALYSIS

| Alloy Test Sample | a Red | b Yellow | L Brightness | Cu/[Ag + 2 Zn] C Color Ratio |
|---|---|---|---|---|
| 1 | 1.03 | 20.37 | 89.50 | 1.16 |
| 2 | 2.70 | 18.30 | 88.10 | 2.06 |
| 3 | 0.90 | 19.10 | 88.80 | 1.13 |
| 4 | 3.15 | 20.50 | 88.70 | 1.48 |
| 5 | 2.70 | 24.50 | 89.20 | 1.00 |
| 6 | 1.25 | 24.80 | 89.10 | 0.67 |

Test sample 2 is a common 14K gold known commercially as 14-79, and test sample 3 is a 14K alloy known as 14-111. Test sample 4 is formulated according to U.S. Pat. No. 5,180,551, which is incorporated herein by reference, and test samples 5 and 6 are commercial 18K gold alloys known as 18-6 and 18-88, respectively. The color values of sample 6, i.e. 18-88 18K gold is considered by many to be the optimal 18K color.

The individual values of a, b, L and C for the present invention are quite close to those of sample 6 and can vary by several percent depending on the exact proportions of the constituent elements selected within the ranges set forth in Table 1. The color coordinates of Table 2 are plotted in FIG. 1 with the test sample number provided next to each plotted point.

Figure 2:
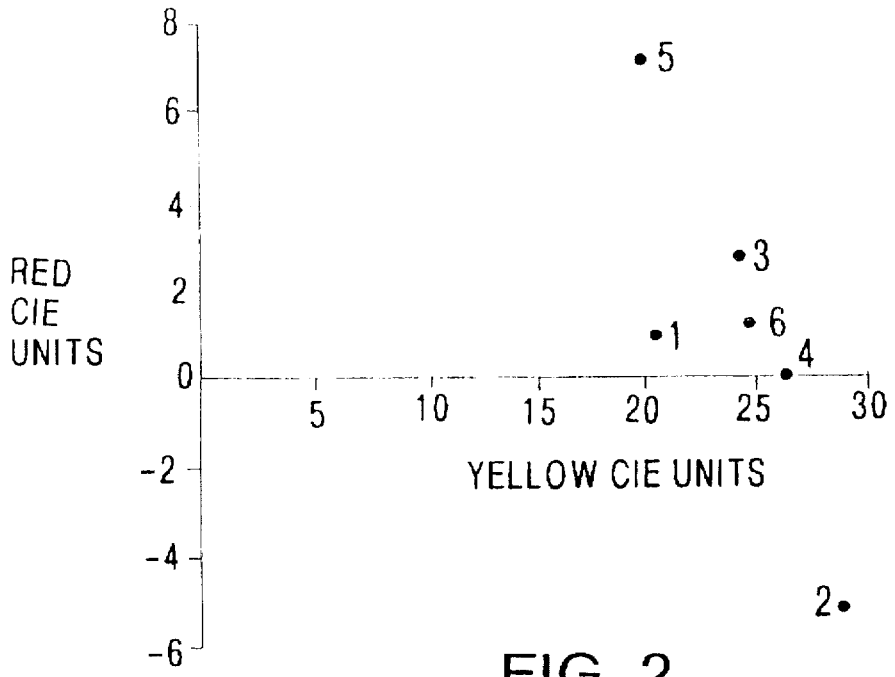
FIG. 2 is a color graph similar to FIG. 1 comparing the alloy of the present invention with several representative 18K gold alloys.

Additional color information is provided in Table 3 which lists the color coordinates and brightness of a gold alloy formulated pursuant to Table 1 in accordance with the invention and identified as Alloy 1. Five other commercially available 18K gold alloy color coordinate values are also listed in Table 3. These color coordinates are plotted in FIG. 2 with the alloy number provided next to each plotted point.

Figure 3:
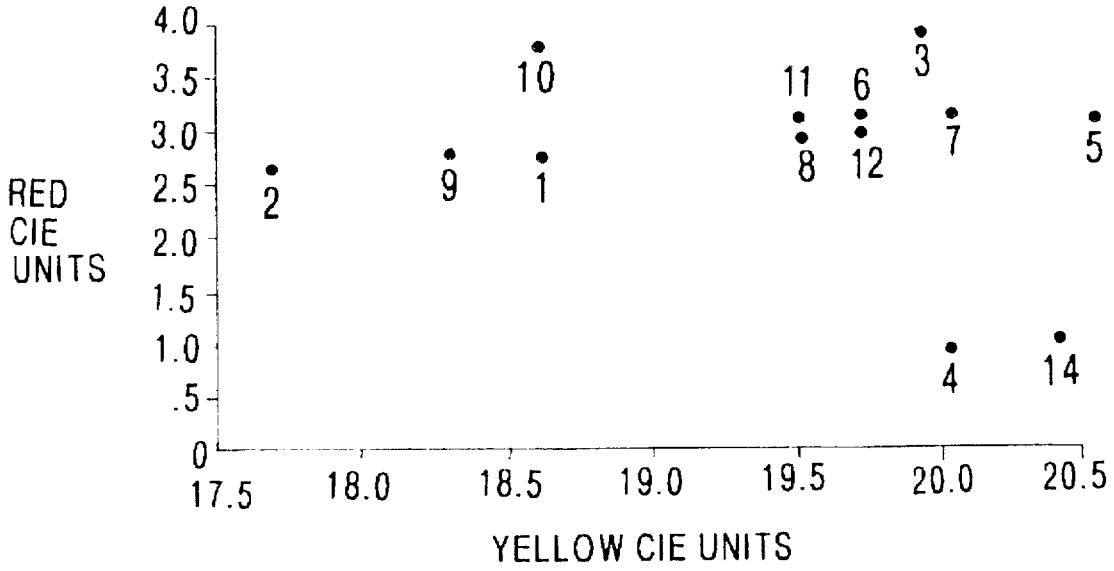
FIG. 3 is another color graph similar to FIGS. 1 and 2 plotting the color coordinates of the alloys listed in Table 11.

FIG. 3 provides another color plot comparison of the alloy of the present invention (Alloy 14) with twelve other representative 14K gold alloys. The other color coordinates and other alloy data for the alloys of FIG. 3 are tabulated in Table 11.

Additional comparisons of the mechanical properties of the present invention with other gold alloys are provided in the following Tables 4 through 13 below for various jewelry configurations. In each case, sample A represents the present invention, sample B is a 14K composition formulated according to U.S. Pat. No. 5,180,551 and samples C through E are commercially available 14K gold alloys.

TABLE 3

COMPARATIVE COLOR ANALYSIS

| Alloy Test Sample | a Red | b Yellow | L Brightness |
|---|---|---|---|
| 1 | 1.03 | 20.37 | 89.50 |
| 2 | −5.30 | 29.00 | 92.10 |
| 3 | 2.70 | 24.50 | 89.20 |
| 4 | 0.00 | 26.40 | 90.30 |
| 5 | 7.30 | 20.00 | 85.70 |
| 6 | 1.25 | 24.80 | 89.10 |

TABLE 4

3/16" BANGLE

| Test Sample | Diamond Pyramidal Hardness (DPH) | Grain Size (MM) |
|---|---|---|
| A[1] | 244 | .005–.010 |
| A[2] | 260 | .015–.020 |
| A[3] | 268 | .020–.050 Top/Bottom of Mount |
| B[4] | 260 | .005–.010 |
| C[5] | 163 | .005–.010 |

[1]-As Received.
[2]-Solution Anneal, 575° F. 1½ Hour Age.
[3]-Solution Anneal, 650° F. 1¼ Hour Age.
[4]-As Received.
[5]-As Received.

TABLE 5

HERRINGBONE #5

| Test Sample | Tensile (Lbs) | Yield (Lbs) | Elongation (%) | Diamond Pyramidal Hardness (DPH) | Grain Size (MM) |
|---|---|---|---|---|---|
| A[1] | 7 | 4 | 50 | 251 | .035 |
| B[2] | 16.4 | 8.4 | 65 | 246 | .025–.035 |
| C[3] | 9.25 | 3.2 | 60 | 159 | .010 & .035 Duplex |
| E[4] | 3.8 | 1.6 | 56 | 246 | .015 |
| E[5] | 4.3 | 2.6 | 53 | 271 | .015–.020 |
| E[6] | 3.8 | 2 | 125 | 250 | .015–.020 |

[1]-As Received.
[2]-As Received.
[3]-As Received.
[4]-Test #1 - 2.75 mm × 0.88 mm.
[5]-Test #2 - 3.5 mm × 0.88 mm.
[6]-Test #3 - 3.0 mm × 0.88 mm.

TABLE 6

STAMPADO*

| Test Sample | Tensile (Lbs) | Yield (Lbs) | Elongation (%) | Diamond Pyramidal Hardness (DPH) | Grain Size (MM) |
|---|---|---|---|---|---|
| A[1] | | | | 192/146 | Varies .010–.060 |
| A[2] | 14 | 10 | 13 | 191 | Heart .035– |

TABLE 6-continued

| STAMPADO* | | | | | |
|---|---|---|---|---|---|
| Test Sample | Tensile (Lbs) | Yield (Lbs) | Elongation (%) | Diamond Pyramidal Hardness (DPH) | Grain Size (MM) |
| C[3] | 9.25 | 3.2 | 60 | 159 | .045 (Back) × .035 (Back) Heart .015 (Back) × .010 (Back) |

*STAMPADO IS A HOLLOW ARTICLE CONSTRUCTED FROM TWO MATCHING HALF PIECES.
[1]-As Received.
[2]-7.5 Inch.
[3]-7.5 Inch.

TABLE 7

| RINGS | | |
|---|---|---|
| Test Sample | Diamond Pyramidal Hardness (DPH) | Grain Size (MM) |
| A[1] | 191 | >.200 |
| A[2] | 257 | >.200 |
| A[3] | 267 | >.200 |
| A[4] | 263 | >.200 |
| A[5] | 274 | >.200 |
| B[6] | 255 | .035 |
| C[7] | 137 | >.200 |

[1]-As Received.
[2]-Aged from Received, 575° F. 1½ Hours.
[3]-Solution Anneal, 575° F. 1½ Hours.
[4]-Aged from Received, 650° F. 1¼ Hours.
[5]-Solution Anneal, 650° F. 1¼ Hours.
[6]-As Cast.
[7]-As Cast.

TABLE 8

| HOOPS | | |
|---|---|---|
| Test Sample | Diamond Pyramidal Hardness (DPH) | Grain Size (MM) |
| A[1] | 238 | .005–.010 50% .010–.015 50% .025–.035 |
| A[2] | 244 | .005–.010 50% .010–.015 50% .025–.035 |
| A[3] | 260 | .010–.025 50% .010–.015 50% .020–.025 |
| C[4] | 156 | .010–.015 |

[1]-As Received.
[2]-Solution Anneal, 575° F. 1½ Hour Age.
[3]-Solution Anneal, 650° F. 1¼ Hour Age.
[4]-As Received.

TABLE 9

| SOLID ROPE | | | | | |
|---|---|---|---|---|---|
| Test Sample | Tensile (Lbs) | Yield (Lbs) | Elongation (%) | Diamond Pyramidal Hardness (DPH) | Grain Size (MM) |
| A[1] | 30 | 17.5 | 25 | 249 | .025 |
| A[2] | 33 | 18.3 | 25 | | |
| B[3] | 34 | 19.5 | 36 | 180 | .020 |
| C[4] | 36 | 11.5 | 40 | 131 | .045 |
| D[5] | 28 | 11 | 37.5 | 127 | .035 |
| D[6] | 30 | 9 | 40 | | |

[1]-Test #1 - 18 Inch.
[2]-Test #2 - 18 Inch.
[3]-As Received, made from Rect Wire.
[4]-As Received, made from Rect Wire.
[5]-Test #1 - 18 Inch.
[6]-Test #2 - 18 Inch.

TABLE 10

| HOLLOW ROPE | | | | | |
|---|---|---|---|---|---|
| Test Sample | Tensile (Lbs) | Yield (Lbs) | Elongation (%) | Diamond Pyramidal Hardness (DPH) | Grain Size (MM) |
| C | 8 | 4 | 45 | 135 | .015 |
| A[1] | 10 | 3 | 43 | 244 | .010 |
| A[2] | 13 | 4 | 45 | | |
| A[3] | 21 | 11 | 25 | 248 | .010 |
| A[4] | 18 | 9 | 28 | | |
| C | 4.3 | 1.3 | 30 | 112 | .015 |
| D[5] | 11 | 3 | 50 | 123 | .020 |
| D[6] | 13 | 2.5 | 47 | | |
| E[7] | 7.5 | 4.5 | 25 | 121 | .020 |
| E[8] | 9 | 4 | 37.5 | | |

[1]-Test #1 - Sample 1.
[2]-Test #2 - Sample 1.
[3]-Test #1 - Sample 2.
[4]-Test #2 - Sample 2.
[5]-Test #1 - Sample 1.
[6]-Test #2 - Sample 1.
[7]-Test #1 - Sample 1.
[8]-Test #2 - Sample 1.

As can be appreciated from the test data provided above, the present invention exhibits a relatively high Vickers hardness (200 grams load) (VHN). After annealing and quenching, the alloy may be age hardened by heat treatment at about 600° F. to 700° F for 20 to 75 minutes. Maximum hardness usually is achieved at about one hour. Age hardening may also be performed on articles which have been cold worked provided the articles are first annealed as noted above prior to cold working.

TABLE 11

COMPARATIVE ALLOY ANALYSIS

| | 14 KARAT KNOWN ALLOY FORMULATIONS WEIGHT PERCENT BY COMPOSITION | | | | | | HARDNESS | | | COLOR | | | HARDEN-ABILITY | |
|---|---|---|---|---|---|---|---|---|---|---|---|---|---|---|
| ALLOY | Au | Ag | Zn | Co | Ni | Cu | AN-NEALED VHN | AGED VHN | RATIO Cu/Ag | YELOW "b" | RED "a" | RATIO Cu/(Ag + 2 Zn) | RATIO Ag/(Ag + Cu) × 100% | DENSITY DWT/ CU. IN. |
| 1 | 58.25 | 3.80 | 5.80 | 0.00 | 0.35 | 31.80 | 120 | 130 | 8.37 | 18.60 | 2.80 | 2.06 | 10.67 | 135.4618 |
| 2 | 58.25 | 3.80 | 5.80 | 0.80 | 0.35 | 31.80 | 155 | 156 | 8.16 | 17.70 | 2.60 | 2.01 | 10.67 | 133.9056 |
| 3 | 58.25 | 3.80 | 4.70 | 0.80 | | 32.45 | 150 | 150 | 8.49 | 19.90 | 4.00 | 2.44 | 10.48 | 135.9979 |
| 4 | 58.25 | 12.20 | 4.70 | 0.40 | | 24.45 | 154 | 248 | 2.00 | 20.00 | 1.00 | 1.13 | 33.29 | 138.4507 |
| 5 | 58.25 | 12.20 | 2.70 | 0.50 | | 26.35 | 166 | 256 | 2.16 | 20.50 | 3.15 | 1.50 | 31.65 | 139.4985 |
| 6 | 58.25 | 12.20 | 2.70 | 0.40 | | 28.45 | 151 | 246 | 2.17 | 19.70 | 3.15 | 1.50 | 31.57 | 139.5011 |
| 7 | 58.25 | 12.20 | 2.70 | 0.60 | | 26.25 | 177 | 275 | 2.15 | 20.00 | 3.20 | 1.49 | 31.73 | 139.4959 |
| 8 | 58.25 | 6.10 | 4.70 | 0.60 | | 30.35 | 150 | 150 | 4.98 | 19.50 | 3.00 | 1.96 | 16.74 | 136.6631 |
| 9 | 58.25 | 6.10 | 4.70 | 0.80 | | 30.15 | 155 | 160 | 3.77 | 18.30 | 2.80 | 1.73 | 16.83 | 136.6581 |
| 10 | 58.25 | 10.00 | 2.70 | 1.00 | | 28.05 | 183 | 248 | 2.81 | 18.60 | 3.75 | 1.82 | 26.28 | 138.8276 |
| 11 | 58.25 | 12.20 | 2.70 | 0.40 | 0.005 | 26.44 | 155 | 245 | 2.16 | 19.50 | 3.10 | 1.50 | 31.57 | 139.5217 |
| 12 | 58.25 | 12.20 | 2.70 | 0.60 | 0.005 | 26.24 | 180 | 276 | 2.18 | 19.70 | 3.10 | 1.50 | 31.74 | 139.5166 |
| 13 | 58.48 | 11.86 | 2.60 | 0.38 | 3.00 | 23.68 | NA | NA | 2.00 | NA | NA | 1.39 | 33.37 | 139.6690 |
| 14 | 58.68 | 13.49 | 3.50 | 0.37 | | 23.96 | 135 | 270 | 1.78 | 20.37 | 1.03 | 1.17 | 36.02 | 139.9429 |

Table 11 provides additional comparisons between an alloy formulated in accordance with the present invention, i.e. alloy 14, and 13 other known 14K gold alloy formulations. It is readily seen that the present invention has one of the lowest annealed hardness values of VHN 135 and one of the highest age hardened hardness values of VHN 270, and the greatest difference or spread between these values of 135 (VHN 270–VHN 135=135).

The color values listed in Table 11 of 20.37 for yellow and 1.03 for red associated with alloy 14 of the present invention are respectively among the highest and lowest values of the alloys tested. As noted above, this results in a distinctive rich gold color. The yellow and red color coordinates "b" and "a" listed in Table 11 are plotted in FIG. 3 as noted above.

As further seen in Table 11, the Cu/Ag hardness ratio of 1.78 of the present invention is significantly lower than all of the other 14K gold alloys tested and the hardenability ratio of 36.02% is significantly greater than all of the other 14K gold alloys tested resulting in a harder alloy after heat treating.

The density of the present invention expressed in dwt/in$^3$ is 139.94, which is the highest of any known 14K gold alloy. There are 20 dwt units per troy ounce. This high density is not only desirable because of the resulting sensation of substantiality provided by a heavy gold article, but the high density is a reflection of the fineness of the alloy and reflectively affects brightness.

TABLE 12

COMPARATIVE ALLOY TESTING

| Test Sample | Tensile (Lbs) | Yield (Lbs) | Elongation (%) | Age Hardened (VHN) | Grain Size (MM) |
|---|---|---|---|---|---|
| (SOLID ROPE CHAIN) | | | | | |
| A | 38 | 21.1 | 40 | 218 | 0.015 |
| B | 34 | 19.5 | 36 | 180 | 0.020 |
| C | 36 | 11.5 | 40 | 131 | 0.045 |
| (HOLLOW ROPE CHAIN) | | | | | |
| A | 16 | 4.5 | 45 | 233 | 0.010 |

TABLE 12-continued

COMPARATIVE ALLOY TESTING

| Test Sample | Tensile (Lbs) | Yield (Lbs) | Elongation (%) | Age Hardened (VHN) | Grain Size (MM) |
|---|---|---|---|---|---|
| B | NA | NA | NA | NA | NA |
| C | 8.6 | 1.3 | 30 | 112 | 0.015 |
| (HERRINGBONE) | | | | | |
| A | 17.2 | 8.6 | 62 | 251 | 0.035 |
| B | 16.4 | 8.4 | 65 | 246 | 0.035 |
| C | 9.3 | 3.2 | 60 | 159 | 0.035 |
| (BANGLE BRACELET) | | | | | |
| A | NA | NA | NA | 268 | 0.010 |
| B | NA | NA | NA | 260 | 0.010 |
| C | NA | NA | NA | 163 | 0.010 |
| (HOOP EARRING) | | | | | |
| A[2] | NA | NA | NA | 260 | 0.010 |
| B | NA | NA | NA | NA | NA |
| C | NA | NA | NA | 156 | NA |

[1]-Age Hardened, 650° F. 1¼ Hour Age.
[2]-Age Hardened, 650° F. 1¼ Hour Age.

Additional test results and measurements are provided in Table 12 for various jewelry configurations. In each case, test sample A represents an embodiment of the present invention, test sample B is a 14K gold composition formulated according to U.S. Pat. No. 5,180,551, and test sample C is a 14K gold considered standard throughout the industry. It should be noted that a VHN of 274 for a cast ring formed with an alloy formulated according to the present invention, i.e. within the ranges of Table 1, is the highest VHN of any other 14K gold alloy tested.

TABLE 13

STRETCH TEST
(Starting Length = 2" Stretched 0.150")

| Test Sample | Pounds | Starting Length | Finished Length |
|---|---|---|---|
| A Test #1-5 mm | 10 | 2" | 2 1/16" |
| A Test #2-5 mm | 10 | 2" | 2 1/8" |
| C 5 mm | 5 | 2" | 2 1/16" |
| A Test #1-3 mm | 4 | 2" | 2 1/8" |
| A Test #2-3 mm | 4 | 2" | 2 1/16" |
| C Test #1-3 mm | 2 | 2" | 2 3/16" |
| C Test #2-3 mm | 2 | 2" | 2 3/16" |
| C Test-3 mm* | 4 | 2" | 3 5/8" |
| E Test #1-2.75 mm | 2.8 | 2" | 2 1/16" |
| E Test #2-3.5 mm | 3 | 2" | 2 1/16" |
| E Test #3-3.0 mm | 2 | 2" | 2 1/16" |

*SPECIAL TEST CONCLUDING THAT A SIMILAR 4 LB LOAD CREATES SUBSTANTIALLY GREATER STRETCH.

When the present invention in the form of sample A was compared to a conventional 14K gold alloy B in the stretch tests listed in Table 13, it was found that the present invention stretched far less than alloy B. This is obviously an advantage when a shaped gold article, such as a jewelry piece, requires dimensional and shape stability, i.e. strength and resistance to deformation.

Figure 6:
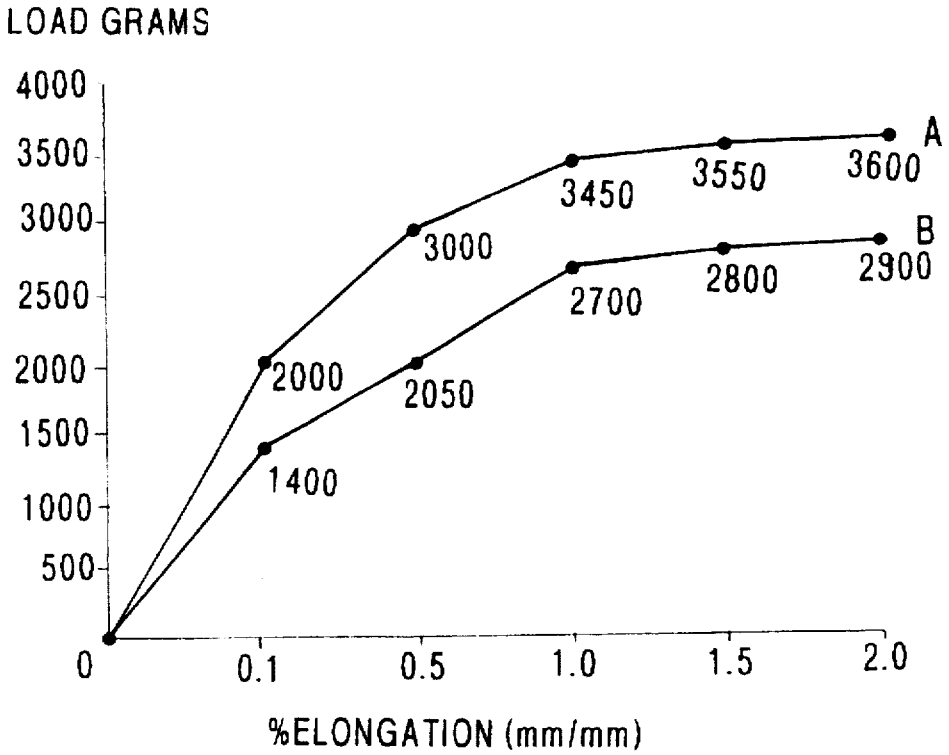
FIGS. 4, 5, and 6 are tensile stress-strain plots comparing the tensile strength of three different chain configurations each respectively formed with a 14K alloy of the present invention and with identical chains formed of commercially-available 14K gold.
Figure 4:
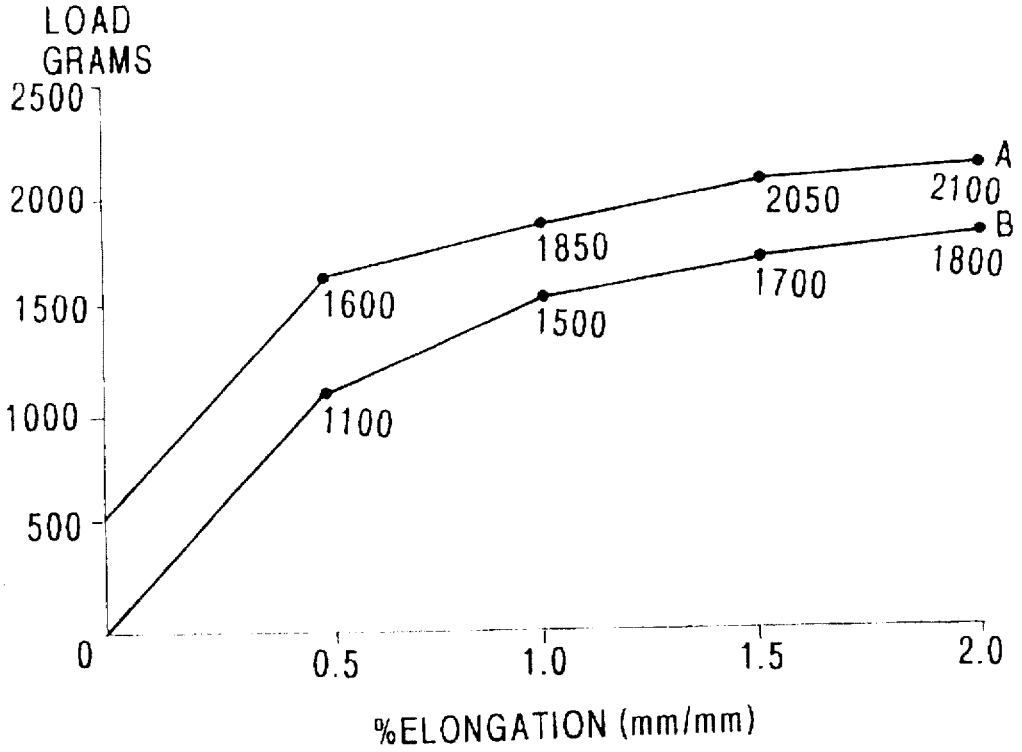
Figure 5:
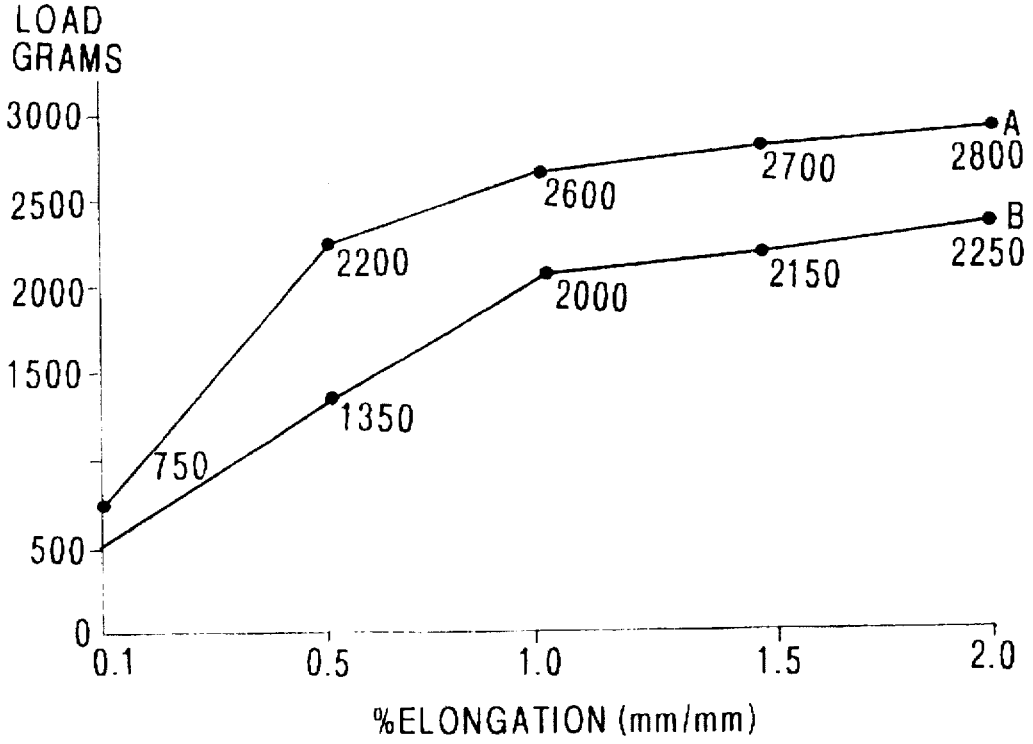

As seen in FIGS. 4, 5 and 6, stress and strain data has been plotted to compare the tensile strength and elongation of three different chain configurations identically constructed with 14K gold alloy A formulated in accordance with the present invention, and alloy B which is a representative commercially-available 14K gold alloy. In FIG. 4, identical 3 mm compressed triple herringbone chains were subjected to variable loads up to a 2% deformation limit or 2 mm on a 100 mm length chain. The alloy of the present invention is shown to be clearly stronger.

A plot similar to FIG. 4 is provided in FIG. 5 wherein identical semi-solid, double open link, hollow lace chains were compared with alloy A again exhibiting superior strength over alloy B. FIG. 6 is a stress-strain plot of 14K gold hollow lace chains configured in a style known as semi-solid Gucci. Again, alloy A of the present invention proves to be the stronger of the two 14K alloys. All testing was completed using an Instron Series IS System with the only variable in the test being the alloy compositions.

Additional stress analyses have been conducted using the exact items, fabricated and produced by the same factory, using the exact same production techniques with the only variable being a change in the alloy from a standard 14 karat alloy to an alloy formulated according to Table 1, i.e. according to the invention. In one such analysis, a stress (resistance) test, the yield point of the test sample produced with a gold alloy according to the invention exhibited a yield point at a load of 1879 grams and a break point at 3146 grams. This represents a 57.11% increase in yield strength and a 64.8% increase in breaking strength above an identical test sample formulated from a conventional 14K gold alloy which yielded at 1196 grams and broke at 1909 grams.

Additional testing over a grouping of five samples formulated with the alloy according to the present invention resulting in an average yield point of 265.64 grams and an average break point of 496.78 grams. The average difference between break point and yield point of these samples was 187.01%. This large difference between yield point and break point provides an indication of the superior strength and durability of the present invention.

Additional testing carried out on nine other test samples formulated in accordance with the invention produced an average yield point of 408.17 grams and an average break point of 574.36 grams. The average difference between break point and yield point of these samples was 140.72%.

There has been disclosed heretofore the best embodiment of the invention presently contemplated. However, it is to be understood that various changes and modifications may be made thereto without departing from the spirit of the invention.

What is claimed is:

1. A hardenable gold alloy, consisting essentially of, by weight:

58.53 to 58.80% gold;
12.80 to 14.39% silver;
22.96 to 24.80% copper;
3.50 to 4.08% zinc; and
0.20 to 0.50% cobalt;

and wherein said alloy is hardenable over a range of greater than 100 (VHN).

2. The gold alloy of claim 1, containing 58.7% gold, 13.39% silver, 23.96% copper, 3.58% zinc and 0.37% cobalt.

3. The gold alloy of claim 1, wherein said alloy exhibits a gold color having a red component a of about 1 CIE unit.

4. The gold alloy of claim 1, wherein said alloy exhibits a gold color having a yellow color component b of about 20 CIE units.

5. The gold alloy of claim 1, wherein said alloy exhibits a gold color having a brightness component L of at least about 89 CIE units.

6. The gold alloy of claim 1, wherein said alloy exhibits a color ratio of about 1.25 to 1.01.

7. The gold alloy of claim 1, wherein said alloy comprises a color ratio of about 1.17.

8. The gold alloy of claim 1, wherein said alloy comprises a hardness ratio of about 1.8.

9. The gold alloy of claim 1, wherein said alloy comprises a hardenability ratio of about 36%.

10. The gold alloy of claim 1, wherein said alloy comprises a melting point of about 1575° F.

11. The gold alloy of claim 1, wherein said alloy comprises a heat treated alloy having a VHN hardness of greater than about 260.

12. The gold alloy of claim 1, wherein said alloy comprises a density of about 140 dwt/in$^3$.

13. A hardenable gold alloy, consisting essentially of, by weight:

58.53 to 58.80% gold;
12.80 to 14.39% silver;
22.96 to 24.80% copper;
3.50 to 4.08% zinc; and
0.20 to 0.50% cobalt;

and wherein said copper and said silver are present in a hardness ratio of about 1.5 to 1.9.

14. The gold alloy of claim 13, wherein said copper, said silver and said zinc are present in a color ratio of about 1.0 to 1.2.

15. The gold alloy of claim 14, wherein said alloy is hardenable over a range of greater than 100 (VHN).

16. A hardenable gold alloy, consisting essentially of, by weight:

58.53 to 58.80% gold;
12.80 to 14.39% silver;
22.96 to 24.80% copper;
3.50 to 4.08% zinc; and
0.20 to 0.50% cobalt;

and wherein said copper, said silver and said zinc are present in a color ratio of about 1.0 to 1.2.

17. The gold alloy of claim 16, wherein said alloy is hardenable over a range of greater than 100 (VHN).

* * * * *